US012066023B2

(12) United States Patent
Müller et al.

(10) Patent No.: US 12,066,023 B2
(45) Date of Patent: Aug. 20, 2024

(54) DRY VACUUM PUMP

(71) Applicant: Ateliers Busch SA, Chevenez (CH)

(72) Inventors: Didier Müller, Delémont (CH); Théodore Iltchev, Grandvillars (FR); Artur Bachmann, Maulburg (DE)

(73) Assignee: ATELIERS BUSCH SA, Chevenez (CH)

( * ) Notice: Subject to any disclaimer, the term of this patent is extended or adjusted under 35 U.S.C. 154(b) by 0 days.

(21) Appl. No.: 17/914,533

(22) PCT Filed: May 10, 2021

(86) PCT No.: PCT/EP2021/062383
§ 371 (c)(1),
(2) Date: Sep. 26, 2022

(87) PCT Pub. No.: WO2021/228793
PCT Pub. Date: Nov. 18, 2021

(65) Prior Publication Data

US 2023/0143219 A1 May 11, 2023

(30) Foreign Application Priority Data

May 11, 2020 (WO) ..... PCT/EP2020/063009

(51) Int. Cl.
*F04C 18/12* (2006.01)
*F04C 18/08* (2006.01)
(Continued)

(52) U.S. Cl.
CPC ..... *F04C 18/126* (2013.01); *F04C 18/16* (2013.01); *F04C 29/005* (2013.01);
(Continued)

(58) Field of Classification Search
CPC .... F04C 18/126; F04C 29/005; F04C 18/084; F04C 2220/12; F04C 2240/20; F04C 2240/80
See application file for complete search history.

(56) References Cited

U.S. PATENT DOCUMENTS 6,485,274 B2 11/2002 Kosters
2006/0120890 A1 6/2006 Moorhouse et al.
2015/0219102 A1* 8/2015 Aubert ..... F04C 29/005 417/362

FOREIGN PATENT DOCUMENTS

CN 103895703 A * 7/2014
DE 3706588 C1 8/1988
(Continued)

OTHER PUBLICATIONS

English Machine Translation of FR527725A1, translated by USPTO Fit Database. (Year: 1983).*
(Continued)

*Primary Examiner* — Dominick L Plakkoottam
*Assistant Examiner* — Paul W Thiede
(74) *Attorney, Agent, or Firm* — Tucker Ellis LLP

(57) ABSTRACT

The present invention concerns a dry vacuum pump comprising:

a drive device (1) comprising a drive shaft (3) at one end of which is fixed at least one drive wheel (4) provided to set in motion at least one belt (5);

at least two parallel rotors (7, 8) each having a shaft (9, 10) provided with a rotor element (11, 12), this shaft (9, 10) being able to be driven in rotation by the belt (5) and being equipped at one of its axial ends with a toothed wheel (13, 14), this pump having the special features that:

the drive wheel (4) and the belt (5) are smooth;
(Continued)

each shaft (9, 10) of the rotor (7, 8) comprises at least one smooth section (16, 17) arranged to co-operate with the belt (5), and the toothed wheels (13, 14) of the shafts (9, 10) of the rotor (7, 8) are dimensioned and arranged to mesh with one another.

15 Claims, 8 Drawing Sheets

(51) Int. Cl.
*F04C 18/16* (2006.01)
*F04C 29/00* (2006.01)

(52) U.S. Cl.
CPC ..... *F04C 18/084* (2013.01); *F04C 2220/12* (2013.01); *F04C 2240/20* (2013.01); *F04C 2240/80* (2013.01)

(56) References Cited

FOREIGN PATENT DOCUMENTS

| | | | | | |
|---|---|---|---|---|---|
| DE | 10334481 | A1 | * | 3/2005 | ..... F04C 29/005 |
| EP | 1054160 | A1 | | 11/2000 | |
| EP | 2556256 | B1 | * | 1/2020 | ..... F01C 17/00 |
| FR | 2527725 | A1 | * | 12/1983 | |
| JP | H05231366 | A | | 9/1993 | |
| JP | 2000161277 | A | * | 6/2000 | ..... F04C 29/005 |
| KR | 20080083666 | A | * | 9/2008 | |
| WO | 2018224409 | A1 | | 12/2018 | |

OTHER PUBLICATIONS

English Machine Translation of CN103895703A, translated by USPTO Fit Database. (Year: 2014).*

English Machine Translation of EP2556256B1, translated by USPTO Fit Database. (Year: 2020).*

English Machine Translation of KR2008008366A via USPTO Fit Database (Year: 2008).*

English Machine Translation of JP2000161277A via USPTO Fit database on Apr. 1, 2024 (Year: 2000).*

English Translation of Written Opinion issued in PCT/EP2021/062383 mailed Jun. 18, 2021, 4 pages (original French-language document filed in prior IDS).

International Search Report and Written Opinion issued in PCT/EP2021/062383 mailed Jun. 18, 2021, 4 pages.

* cited by examiner

DRY VACUUM PUMP

TECHNICAL FIELD OF THE INVENTION

The present invention concerns a dry vacuum pump, such as a dry compressing vacuum pump which one uses, for example, in so-called white rooms or clean rooms. More specifically, the present invention relates to a dry vacuum pump comprising a drive by belt. Still more specifically, the present invention concerns a dry vacuum pump, for example of positive displacement type, in particular in the form of a Roots pump, which comprises a drive device that guarantees an optimal synchronization of the rotation of the rotors without however requiring use of a lubricating liquid.

STATE OF THE ART

Dry vacuum pumps such as Roots pumps are well known in the state of the art. Such pumps generally comprise two rotor elements disposed in a pumping chamber which in the Roots pumps are designed as rotor elements in the form of lobes. Each rotor element is supported by a rotor shaft which is driven in rotation by a drive device.

In the majority of pumps known from the prior art, the drive device is constituted by two toothed wheels each mounted on one of the rotor shafts and which mesh with one another. One of the two shafts is driven in rotation by a motor, for example an electric motor, driving the second rotor shaft by means of the toothed wheels.

The drive devices comprising toothed wheels which transmit the drive torque of one rotor shaft to the other rotor shaft have the advantage that the use of such wheels allows an automatic synchronization of the rotation of the two rotor shafts. In order to obtain an efficient compression process and a good output, it is necessary to reduce the spacing between the rotor elements, which requires a very precise synchronization. Moreover, when stopping the pump, whether it is intentional or due to a breakdown, the toothed wheels act as "landing gear" which makes it possible to prevent damage to the rotor elements.

The disadvantage of this kind of device lies in the permanent contact, necessary for the transmission of the drive torque, which exists between the toothed wheels, which requires lubrication. In fact, without lubrication, the toothed wheels would want to wear out quickly which would result in a lack of synchronization of the rotor shafts, a decrease in the efficiency of the pump and finally in damage to the rotor elements. Unfortunately, in many applications, use of a lubricating liquid is undesirable because it leads to contamination of the evacuated vacuum chamber. This is, for example, a recurring problem in the field of semiconductors where such contamination is very simply not compatible with the manufacturing processes employed.

Another approach allowing the synchronization of the rotor shafts of a vacuum pump is presented in the European patent application EP1054160A1. This concerns a dry screw pump whose rotor shafts are each driven by their own electric motors, the angular positions of the shafts being determined by resolvers. On the basis of signals of resolvers, the motors of the rotor shafts are synchronized electronically. Although this approach makes it possible to synchronize efficiently the rotor shafts, it requires the use of two separate motors and an electronic system which is not favorable in a large number of applications.

In the international patent application WO 2018/224409 A1, it is proposed to use, for the driving of the rotor shafts of a dry screw pump, a toothed belt which itself is set in motion by the toothed wheel of a drive device. This has the advantage of making it possible to decouple the toothed wheels mounted on the rotor shafts. Without contact between the toothed wheels, lubrication is no longer necessary.

Nevertheless, this type of drive by toothed belt has the major disadvantage that it does not allow a sufficient synchronization of rotation of the rotor shafts to be achieved. In order to prevent damage to the rotor elements due to desynchronization of the rotor shafts, it is proposed in this international application to use rotor elements whose play is greater. Unfortunately, this means that the pumps which use this type of drive are not able to attain the same compression rate as the normal pumps without providing much longer rotor elements and having a greater number of compression pockets.

The object of the present invention is thus to propose a dry vacuum pump having a drive device which does not require lubrication while at the same time guaranteeing a sufficient synchronization of the rotor shafts so that this device can be used in conventional dry vacuum pumps, such as Roots pumps.

SUMMARY OF INVENTION

The present invention has as its main object to propose a dry vacuum pump having a rotor drive mechanism more efficient than that of the pumps of the prior art.

According to the invention, these objects are attained through the subject matter of the independent claim. The more specific aspects of the present invention are described in the dependent claims as well as in the description.

More specifically, an object of the invention is achieved through a dry vacuum pump comprising:

- a drive device comprising a drive shaft at one end of which is fixed at least one drive wheel provided to set in motion at least one belt;
- at least two parallel rotors each having a rotor shaft provided with a rotor element, this rotor shaft being able to be driven in rotation by the belt and being equipped at one of its axial ends with a toothed wheel, this pump being characterized in that:

the drive wheel and the belt are smooth;

each rotor shaft comprises at least one smooth section arranged to co-operate with the belt, and the toothed wheels of the rotor shafts are dimensioned and arranged to mesh with one another.

The driving by belt and the automatic synchronization of the rotors thanks to toothed wheels makes it possible to provide a minimal play between the rotor elements which guarantees a maximal efficiency of the pump, in particular its compression rate, without having to modify the rotors, the rotor elements and/or the stator of the pump. In other words, the drive device of the present invention can be integrated in existing pumps without modifications of the rotor elements and stators without loss of efficiency.

Indeed, the toothed wheels of the rotor shafts allow an automatic synchronization of the rotations of the rotor shafts. In the case of desynchronization of the rotor shafts, for example due to belt slippage, the toothed wheels make it possible to re-synchronize the rotor shafts automatically. As the toothed wheels are only subjected to a load when a re-synchronization is necessary it is not necessary to provide these wheels with lubrication. When the two shafts are synchronous, the toothed wheels, although meshed with each other, they are not subject to a load, which avoids wear and tear of the toothed wheels. In fact, the rotating torque is transmitted by the belt and not by the toothed wheels, in contrast to known prior art pumps.

Moreover, for example in the case of belt breakage, the gear constituted by the toothed wheels of the rotor shafts allows these two shafts to remain integral in rotation. The toothed wheels thus act as "landing gear", or safety gear. In the case of belt failure, the toothed wheels allow the pump to decrease in speed until it stops without the rotors touching and without causing damage.

Thanks to a pump according to the present invention, it is thus possible to eliminate the need for lubrication while ensuring an optimal synchronization of the rotor shafts. Finally, a pump according to the present invention makes it possible to avoid damage to the rotor elements even in the case of an abrupt stop of the driving of the pump, for example in the case of breakage of the belt or a power cut. It is important to note that a pump according to the present invention can comprise any type of motor for the driving of the drive wheel. This motor can be, for example, electrical or thermal.

In a preferred embodiment of the present invention, the toothed wheels are arranged so that the teeth of the respective toothed wheels are subjected to a load only when the rotor shafts are driven in rotation asynchronously. This makes it possible to ensure minimal attrition of the toothed wheels and thus a longer service life for the drive device.

In another preferred embodiment of the present invention, the angular play of the toothed wheels is less than that of the rotor elements. This makes it possible to ensure that the toothed wheels are subject to a load before the rotor elements touch each other and thus to ensure that the rotor elements are not damaged even in the case of sudden stop of the pump.

In a preferred embodiment according to the present invention, the smooth section of each rotor shaft is situated at one end of this shaft. This makes it possible to separate easily a compression zone, in which the fluid to be evacuated is effectively transported and compressed by the rotor elements supported by the rotor shafts, and a driving zone, including the drive device for the rotor shafts and in particular the smooth section of each rotor shaft as well as the belt. This makes it possible to prevent the compression zone from being able to be contaminated by way of the driving zone.

In another preferred embodiment of the present invention, on each rotor shaft, the smooth section has a diameter less than that of the toothed wheel.

In a preferred embodiment according to the present invention, the two toothed wheels are of the same diameter and the two smooth sections are of the same diameter. This allows synchronization of the rotation of the rotor shafts to be facilitated. In effect, by providing for identical diameters, it is easier to ensure that the rotor shafts turn at the same speed.

In still another preferred embodiment of the present invention, the belt surrounds partially one of the smooth sections and is pushed downward by the other. This makes it possible to easily drive the two rotor shafts in reverse rotation. As the dry vacuum pumps known from the prior art, such as, for example, screw pumps, Roots pumps, or claw pumps, normally employ rotor shafts foreseen to be driven in rotation in the opposite direction to each other, the drive device of a pump according to the present invention can be adapted to drive pumps known from the prior art.

In another preferred embodiment of the present invention, the toothed wheel and the smooth section of a rotor shaft are located at the same axial end of this shaft. This makes it possible to provide for a simple geometry of the belt which prevents energy losses and the risk of breakage of the belt.

In another preferred embodiment of the present invention, each smooth section is situated on the circumferential surface of a discoid part. This makes it possible in particular to increase the surface of contact between the belt and the rotor shaft and thus to optimize the driving of the rotor shafts by the belt. In addition, the risk of slipping of the belt with respect to the smooth section is reduced which makes it possible to decrease the risk of desynchronization of the rotor shafts.

In a preferred embodiment according to the present invention, the discoid parts and the drive wheel are substantially in the same plane. This makes it possible to provide for a belt which itself is located in the same plane which decreases the risk of breakage of the belt.

In another preferred embodiment of the present invention, the points coming from the projection of the axes of rotation of the rotor shafts and of the drive shaft are aligned on a plane which is perpendicular to them. Thanks to this, the pressure of the belt on the smooth sections of the rotor shafts is equal which makes it possible to ensure an optimal driving synchronization.

In still another preferred embodiment of the present invention, the distance between the drive shaft and the rotor shaft closest to it is adjustable. This makes it possible to adjust the tension of the drive belt and to optimize the driving of the rotor shafts. By adjusting the tension of the belt, it is possible to minimize the risk of desynchronization of the rotor shafts and thus to prevent the toothed wheels from coming into contact in order to re-establish the synchronization.

In still another preferred embodiment of the present invention, the dry vacuum pump is a dry vacuum pump where the rotor elements have the form of lobes and are fitted into one another.

In a preferred embodiment according to the present invention, the vacuum pump is a Roots pump, a screw pump or a claw pump.

In another preferred embodiment of the present invention, the vacuum pump is single-staged or multi-staged.

Finally, in another preferred embodiment of the present invention, the drive device comprises a drive shaft at one end of which is fixed at least one drive wheel provided to set in motion two belts.

BRIEF DESCRIPTION OF THE DRAWINGS

Other advantages and features of the invention will be described in detail in the following specification which is given with reference to the attached figures, which represent schematically.

DETAILED DESCRIPTION OF THE INVENTION

Figure 1:
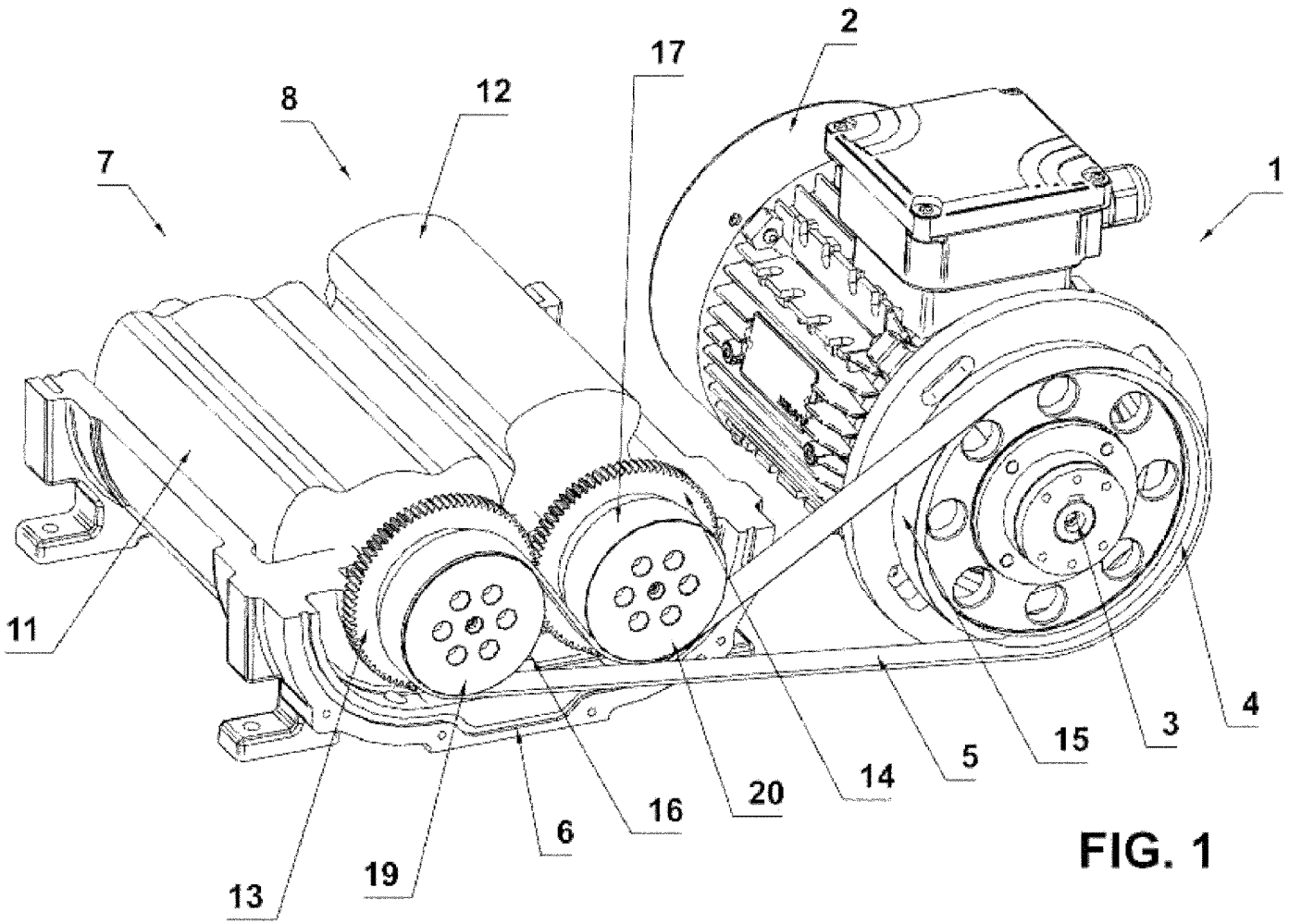
FIG. 1: a dry vacuum pump, here a dry Roots pump, according to a first preferred embodiment of the present invention, in perspective top view.

The dry vacuum pump, according to a first preferred embodiment of the present invention, here in the form of a dry Roots pump and represented in FIG. 1, is an assembly comprising a drive device 1 comprising a motor 2, generally electric, driving in rotation a drive shaft 3 at the front end of which is fixed a drive wheel 4 provided to set in motion a belt 5.

Fixed next to the drive device 1 is a housing comprising a lower part 6 and an upper part (not shown) and in which are mounted, in a way free to rotate, at least two rotors 7, 8. Each rotor 7, 8 includes a rotor shaft 9, 10 provided with a rotor element, here in the form of a lobe 11, 12, and intended to be driven in rotation by the belt 5. Each rotor shaft 9, 10 is equipped at one of its axial ends with a toothed wheel 13, 14, preferably on the front side.

Figure 2:
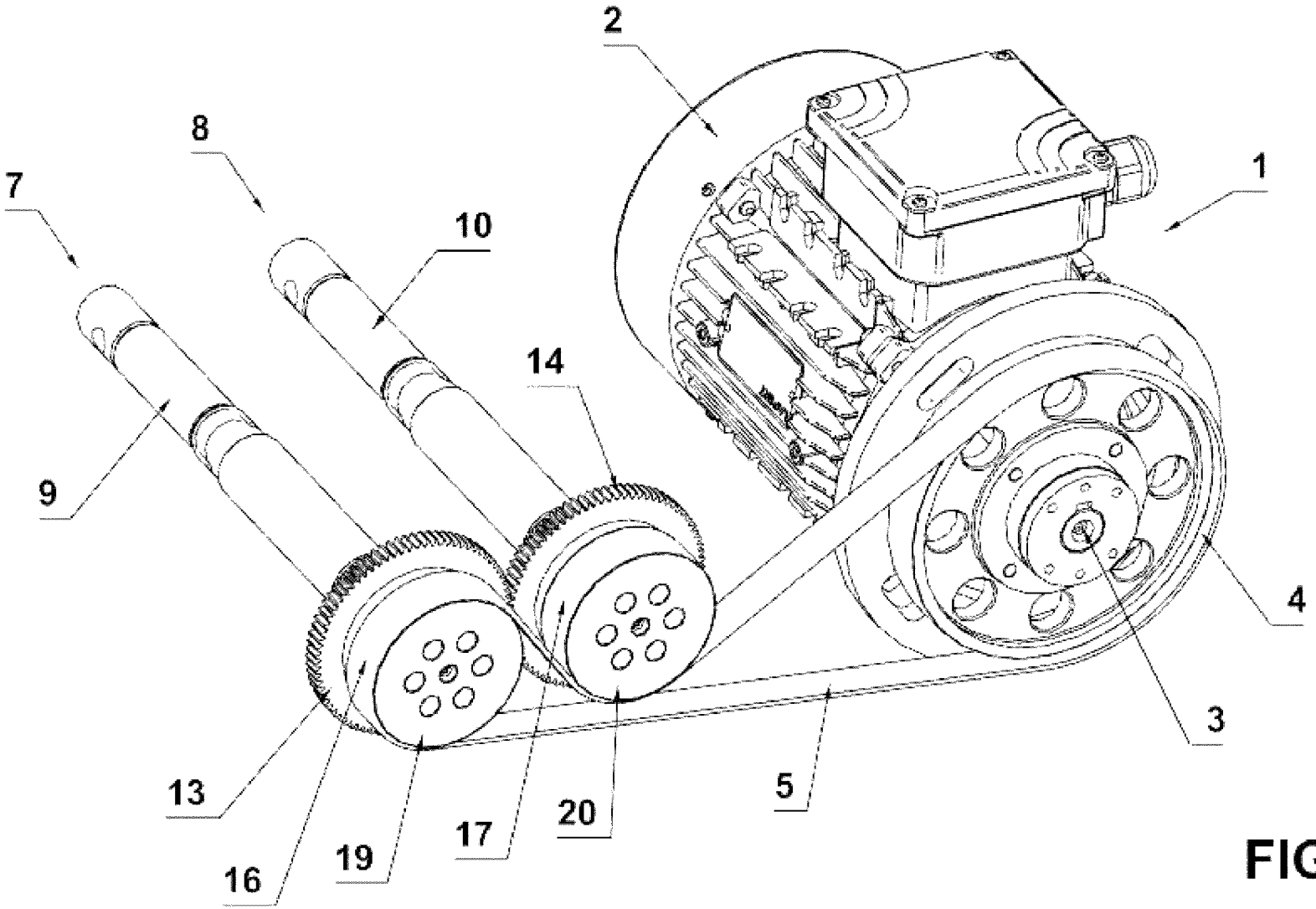
FIG. 2: a part of the vacuum pump of FIG. 1.

As can be seen better in FIG. 2, the axes of rotation of the rotor shafts 9, 10 of the two rotors 7, 8 are parallel with respect to one another and generally likewise parallel to the axis of rotation of the drive shaft 3.

Figure 3:
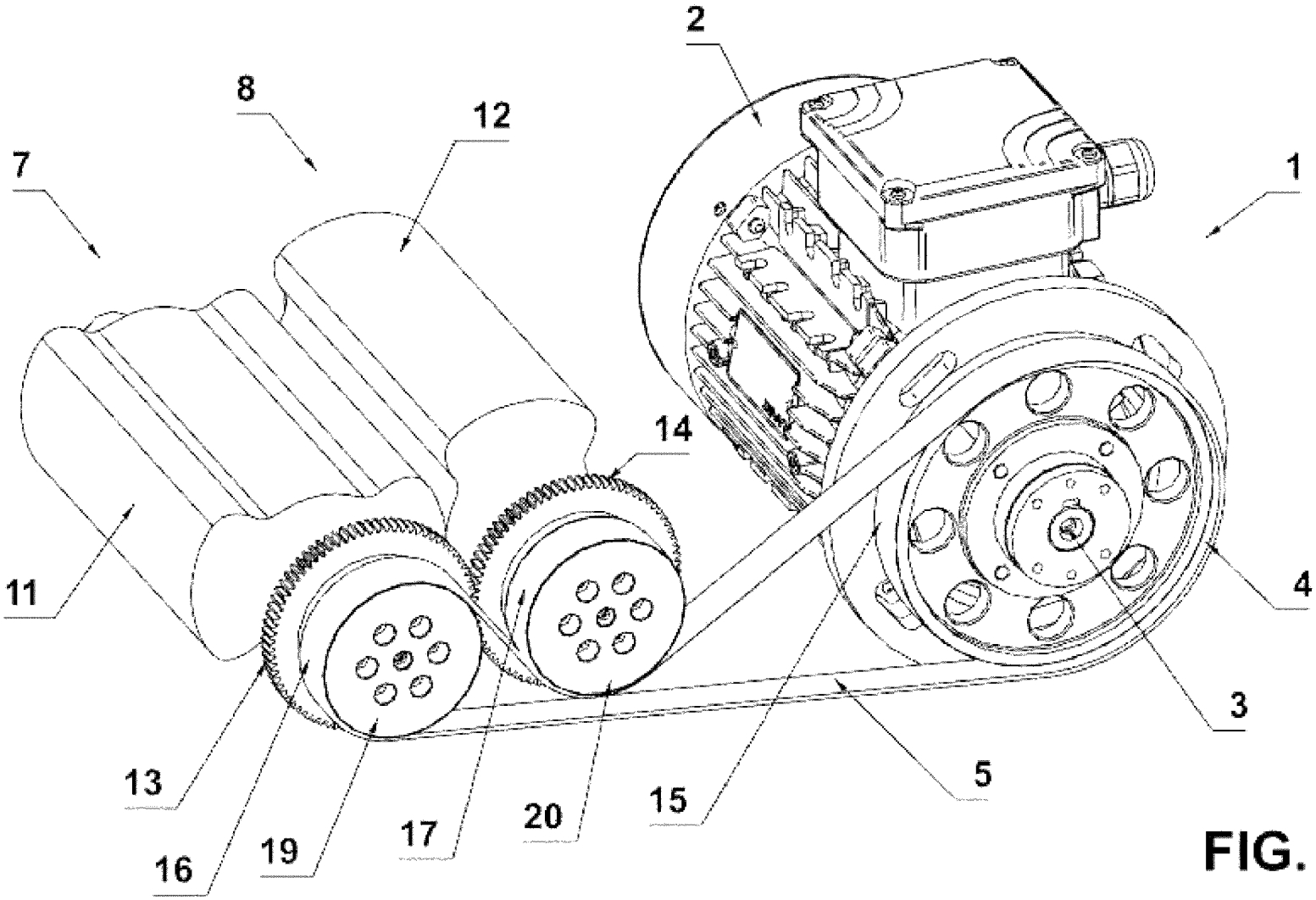
FIG. 3: a part of the vacuum pump of FIG. 1 in which the pump housing is hidden.

The lobes 11, 12 are generally identical and the distance between the axes of rotation of the rotor shafts 9, 10 of the rotors 7, 8 is selected in such a way that these lobes 11, 12 are able to interact in a way so as to be able to create a positive displacement and a compression of fluid to be evacuated as is well known to one skilled in the art. Because the rotors 7, 8 are provided to turn in opposite direction, their lobes 11, 12 are turned, one with respect to the other, at an angle of 90° (cf. FIG. 3).

An inlet orifice (not shown) for a fluid such as air is provided at the rear of the housing and an outlet orifice (not shown) for this fluid is provided in the front. Thus, the rotation of the lobes 11, 12 brings about the circulation and the compression of the fluid.

According to the invention, the belt 5 is smooth, just like the drive wheel 4, which means that this drive wheel 4 has a smooth axial circumferential surface 15.

The smooth drive wheel 4 is intended to co-operate with the belt 5 which adheres to it and can, thanks to this, be set in motion by the rotation of the shaft 3 of the motor 2.

Since the belt 5 is likewise provided to act on the rotor shafts 9, 10 of the rotors 7, 8, by making them turn, these rotor shafts 9, 10 have sections whose axial circumferential surfaces are smooth to receive the belt 5 and make it adhere. These smooth sections 16, 17 are thus situated at the front end of the shafts 9, 10 of the rotors 7, 8.

Figure 4:
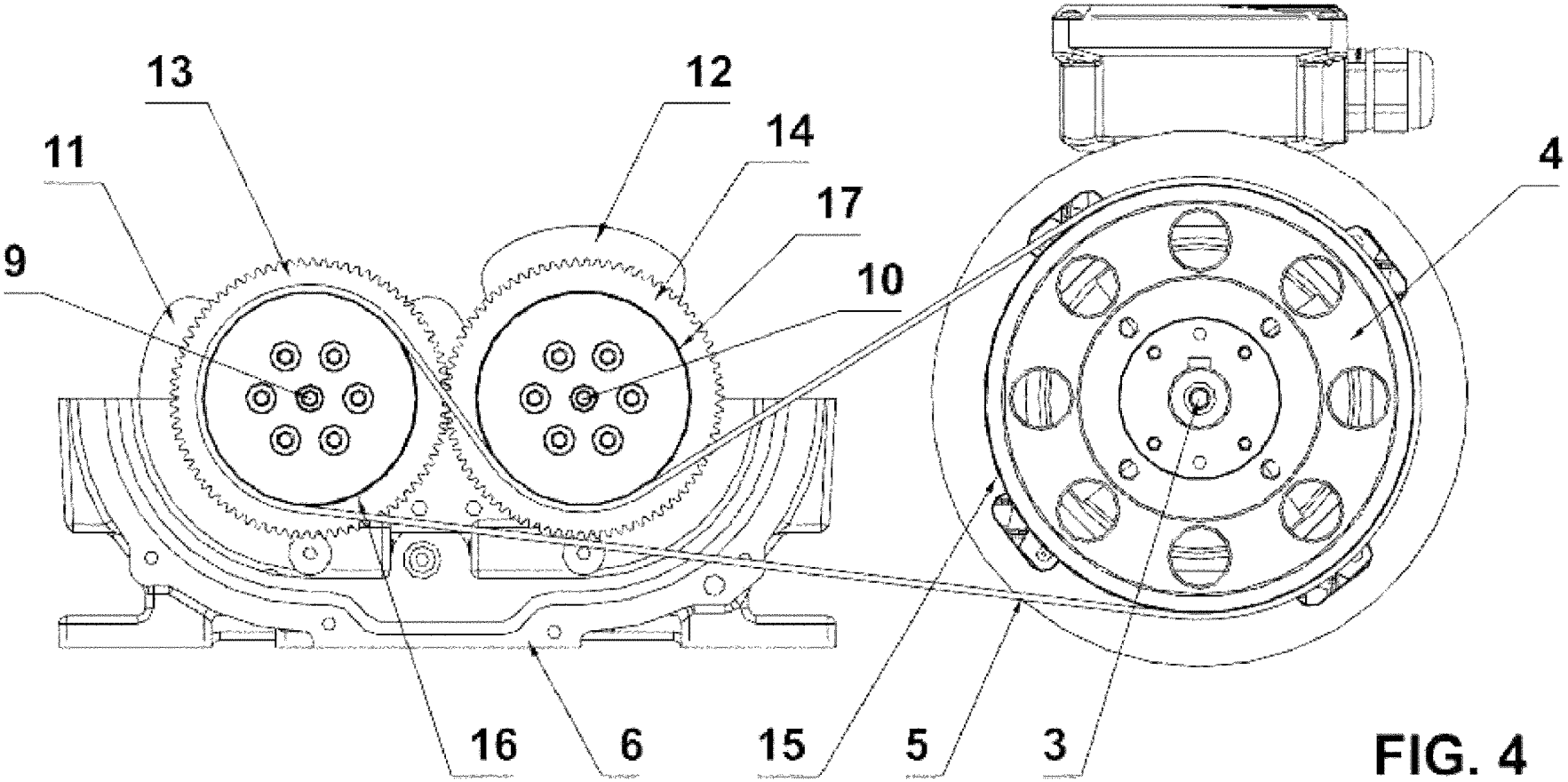
FIG. 4: a front view of the vacuum pump of FIGS. 1 to 3.

As can be seen in particular in FIG. 4, the belt 5 forms a loop going from the drive wheel 4 to the first rotor shaft, that is to say the rotor shaft 9 farthest from the drive wheel 4. The belt 5 thus rests on the smooth axial circumferential surface 15 of the drive wheel 4 and the smooth section 16 of the rotor shaft 9, and it is stretched between this rotor shaft 9 and this drive wheel 4.

However, in order to be able to drive also the second rotor shaft 10 situated between the first rotor shaft 9 and the drive wheel 4, the belt 5 must come into contact with the smooth section 17 of this second rotor shaft 10 and adhere to it. This is achieved by deforming the path of the belt 5 which would be trapezoidal if there were only one shaft. Thus, the path of the belt 5 is bent by forcing it to pass under the smooth section 17 of the second rotor shaft 10.

Thus the belt 5 surrounds partially the wheel 4 of the drive device 1 and the smooth section 16 of the first rotor shaft 9, and it is pressed downward by the smooth section 17 of the second rotor shaft 10.

Preferably, the points coming from the projection of the axes of rotation of the rotor shafts 9, 10 of the rotors 7, 8 and of the drive shaft 3 are aligned on a plane which is perpendicular to them, as shown by the line L drawn in FIG. 4.

The length of the belt 5 and/or the distance between the drive device 1 and the housing are/is selected in such a way that the belt 5 remains sufficiently stretched to be able to fulfil its role of driving in rotation the first 9 and the second 10 rotor shafts of the rotors 7, 8.

Advantageously, it can be foreseen that the distance between the drive device 1 (or the drive shaft 3) and the housing (or the second rotor shaft 10 of the rotor 8) is adjustable, which makes it possible to use belts of variable length and to adjust the tension of the belt 5 in an optimal way.

In order to facilitate their driving in rotation, the rotor shafts 9, 10 of the rotors 7, 8 each preferably comprise a discoid part 19, 20 increasing their diameter and the axial circumferential surface of which is smooth and then constitutes the smooth section 16, 17 of the rotor shaft 9, 10 under consideration. Preferably, the discoid parts are pulleys. The discoid parts 19, 20 and the drive wheel 4 are substantially in the same plane, in such a way as to be able to co-operate effectively with the belt 5. Their axial thicknesses are generally at least equal to that of the belt 5.

According to the invention, the toothed wheels 13, 14 borne by the rotor shafts 9, 10, preferably at the front ends thereof, are dimensioned to mesh with one another and are situated in the same plane. The sum of the radii of these toothed wheels 13, 14 is thus substantially equal to the distance between the two axes of rotation of the rotor shafts 9, 10 of the rotors 7, 8, taking into account the dimensions of the teeth.

It is important to note that, according to the invention, the toothed wheels 13, 14 are dimensioned in such a way that the teeth of these wheels are subjected to a load only when the rotation of the rotor shaft 9, 10 is asynchronous. The rest of the time the toothed wheels 13, 14 mesh well with each other, but their teeth do not undergo load. In fact, the gear formed by the toothed wheels 13, 14 does not have as a function to transmit torque from one rotor shaft to the other, contrary to known prior art pumps. The toothed wheels 13, 14 have solely a function of automatic synchronization of the rotation of the rotor shafts 9, 10. The toothed wheels 13, 14 thus do not need to be lubricated, and the entire drive device of the pump can do without lubricating liquid.

The guarantee of an optimal synchronization of the rotor shafts 9, 10 and thus of the rotors 7, 8, makes it possible to foresee rotor elements 11, 12 with reduced play between them and between the housing of the pump, more specifically the stator part of the pump, in comparison with play existing in prior art pumps equipped with toothed belts. A reduced play between the rotor elements 11, 12 makes it possible finally to achieve compression chambers created by the rotation of the rotor elements 11, 12 whose leaks are less great and thus a greater compression rate for the same pump size.

In addition, in the case of breakage of the belt 5 or in the case of stopping of the pump, the gear formed by the toothed wheels 13, 14 acts as "landing-gear" which makes it possible to avoid damage to the lobes 11, 12 by preventing them from rubbing against each other. In fact, the toothed wheels 13, 14 allow a stop of the synchronized rotors 7, 8 without them being damaged.

Preferably, the smooth sections 16, 17 of the rotor shafts 9, 10 of the rotors 7, 8 have diameters less than those of the toothed wheels 13, 14 borne by these shafts 9, 10.

The toothed wheels 13, 14 are generally of the same diameter, and the two smooth sections 16, 17, whether or not they are located on the discoid parts 19, 20, are also generally of the same diameter.

Figure 5:
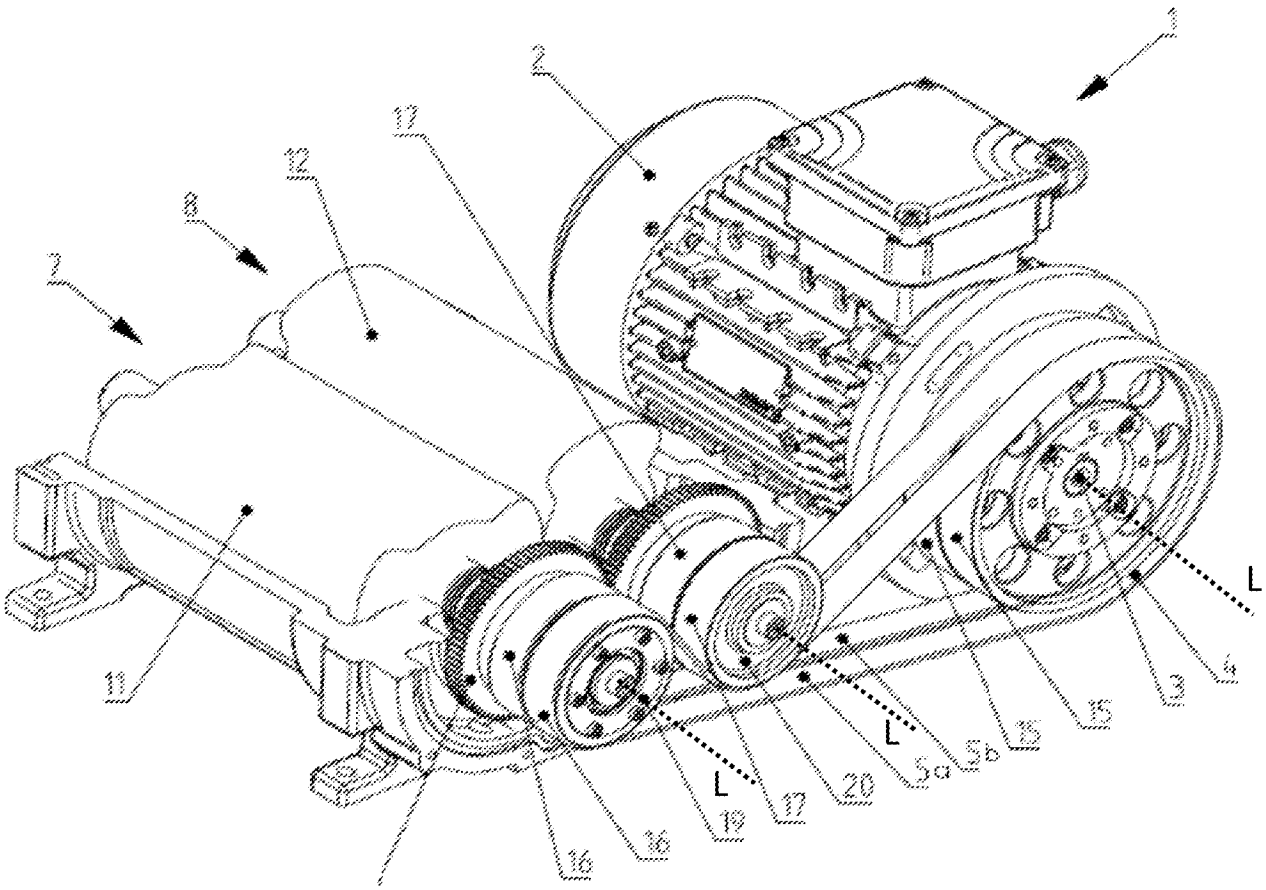
FIG. 5: a dry vacuum pump, here a dry Roots pump, according to a second preferred embodiment of the present invention, in top view and in perspective.

According to a second preferred embodiment of the present invention, the dry vacuum pump, represented in the form of a dry Roots pump in FIG. 5, is an assembly comprising a drive device 1 comprising a motor 2, generally electric, driving in rotation a drive shaft 3 at the front end of which is fixed at least one drive wheel 4 provided to set in motion two belts 5*a*, 5*b*.

According to this embodiment, the two belts 5*a*, 5*b* are smooth, just like the drive wheel 4; this means that this drive wheel 4 has a smooth axial circumferential surface 15.

The smooth drive wheel 4 is intended to co-operate with the two belts 5*a*, 5*b* which adhere to it in parallel and can, thanks to this, be set in motion by the rotation of the shaft 3 of the motor 2. In this embodiment, the smooth drive wheel 4 has a disengagement groove delimiting two smooth areas intended to receive and retain each of the two belts 5*a*, 5*b* axially.

According to a variant, the drive device 1 comprises a drive shaft 3 at the front end of which is fixed two drive wheels 4 provided to set in motion the two belts 5*a*, 5*b*.

Since the two belts 5*a*, 5*b* are also provided to act upon the rotor shafts 9,10 des rotors 7, 8, by making them turn, these rotor shafts 9, 10 have sections whose axial circumferential surfaces are smooth to receive the two belts 5*a*, 5*b* in parallel and make them adhere. These smooth sections 16, 17 are thus situated at the front end of the shafts 9, 10 of the rotors 7, 8, and comprise a disengagement groove delimiting two smooth sections for each rotor shaft 9, 10 intended to receive and retain each of the two belts 5*a*, 5*b* axially.

As can be seen in particular in FIG. 5, the two belts 5*a*, 5*b* each form in parallel a loop going from the drive wheel 4 to the first rotor shaft, that is to say the rotor shaft 9 farthest from the drive wheel 4. The two belts 5*a*, 5*b* thus each rest in parallel on the smooth axial circumferential surface 15 of the drive wheel 4 and the smooth sections 16 of the rotor shaft 9, and they are stretched between this rotor shaft 9 and this drive wheel 4.

However, in order to be able to also drive the second rotor shaft 10 situated between the first rotor shaft 9 and the drive wheel 4, the two belts 5*a*, 5*b* must come into contact with the smooth sections 17 of the second rotor shaft 10 and adhere in parallel thereto. This is achieved by deforming the path of the two belts 5*a*, 5*b* which would be trapezoidal if there were only one shaft. Thus, the path of the two belts 5*a*, 5*b* is bent by forcing them to pass under the smooth sections 17 of the second rotor shaft 10 (cf. FIGS. 5 and 6).

Figure 6:
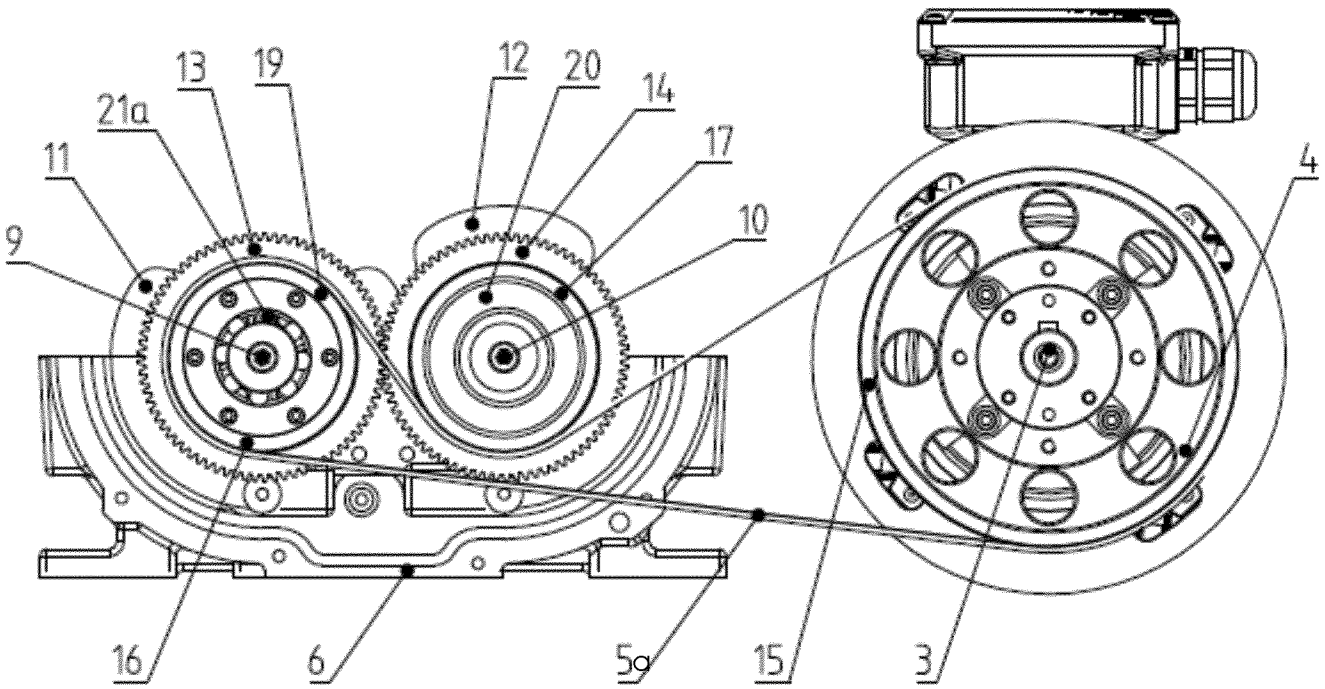
FIG. 6: a front view of the vacuum pump of FIG. 5.

The belts 5*a*, 5*b* therefore partially surround the wheel 4 of the drive device 1 and the smooth sections 16 of the first rotor shaft 9, and they are pressed downward by the smooth sections 17 of the second rotor shaft 10 (cf. FIG. 6).

Figure 7:
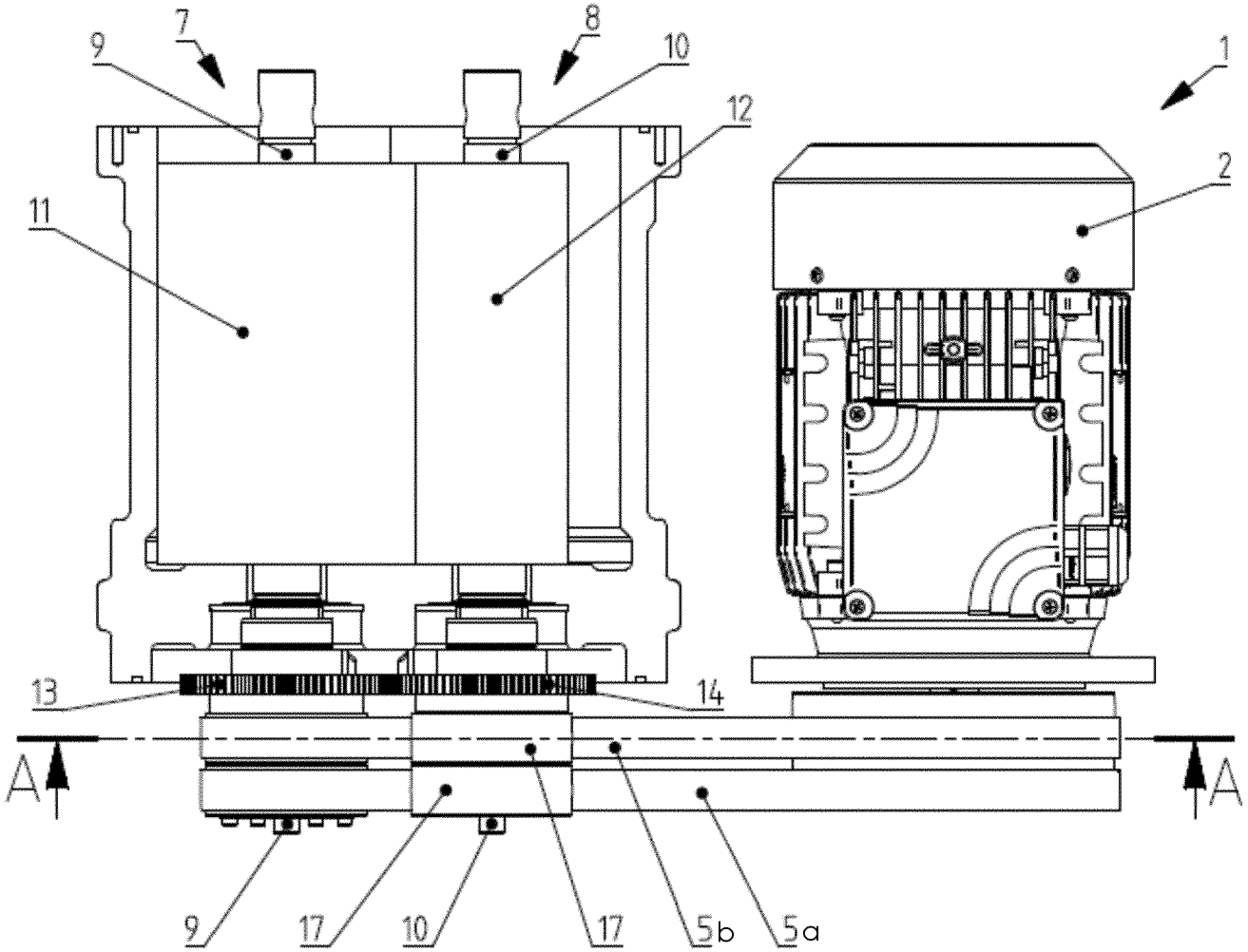
FIG. 7: a top view of the vacuum pump of FIG. 5.

In order to facilitate their driving in rotation, the rotor shafts 9, 10 of the rotors 7, 8 preferably each comprise a discoid part 19, 20, increasing their diameter, the axial circumferential surface of which is smooth and includes a disengagement groove delimiting two smooth zones intended to receive and retain each of the two belts 5*a*, 5*b* axially. The discoid parts 19, 20 then constitute the smooth sections 16, 17 of the rotor shaft 9, 10 under consideration (cf. FIG. 7).

According to a variant, the rotor shafts 9, 10 of the rotors 7, 8 each comprise two discoid parts 19, 20.

The discoid parts 19, 20 and the drive wheel 4 are substantially in the same plane, so as to be able to cooperate effectively with the two belts 5*a*, 5*b*. Their axial thicknesses are generally at least equal to those of the two belts 5*a*, 5*b* (cf. FIG. 7).

Figure 8:
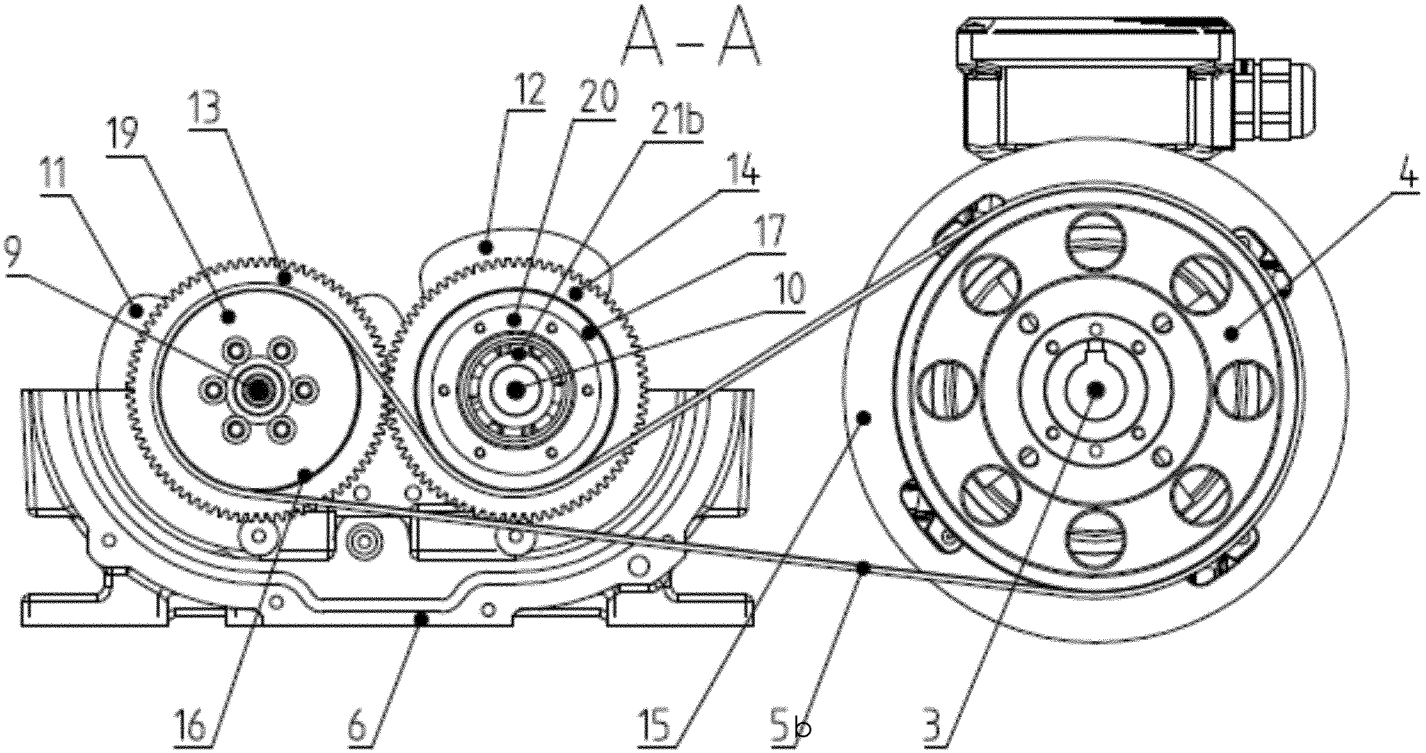
FIG. 8: a front view of the vacuum pump in cross section along the plane A-A of FIG. 7.

In the embodiment represented in FIGS. 6 and 8, the discoid parts 19, 20 comprise bearings 21*a*, 21*b*, such as sealed bearings, ball bearings, or deep groove ball bearings.

Generally the risk of slipping of a belt is a function of the torque and of the grip angle of the belt on the discoid parts. In an advantageous way, according to the second preferred embodiment of the invention, each of the two belts 5*a*, 5*b* runs a risk of slipping independently, making it possible to further reduce the work of resynchronization of the toothed wheels. Compensation for the risk of slipping with the aid of two belts 5*a*, 5*b* thus makes it possible to decrease and limit the risk of desynchronization of the toothed wheels and their attrition.

It is evident that the present invention is subject to many variations in its implementation. Although two non-limiting embodiments have been described by way of example, it is well understood that that it is not conceivable to identify exhaustively all the possible variations. It is of course possible to replace a described means with an equivalent means without departing from the scope of the present invention. All these modifications form part of the common knowledge of one skilled in the art in the field of vacuum pumps. In particular, one skilled in the art will easily recognize that the drive device by belt of the present invention can be used in any kind of positive displacement pump employing two rotors driven in rotation, such as, for example, a screw pump or a claw pump, regardless of whether they are lubricated or dry or whether they are single-staged or multi-staged.

The invention claimed is:

1. A dry vacuum pump comprising:

a drive device comprising a drive shaft at one end of which is fixed to at least one drive wheel provided to set in motion at least one belt;

at least two parallel rotors each having a rotor shaft provided with a rotor element, each said rotor shaft being drivable in rotation by the belt and being equipped at one of its axial ends with a toothed wheel, wherein the at least one drive wheel and the at least one belt are smooth;

the rotor shaft of each rotor comprising at least one smooth section arranged to co-operate with the belt, and the toothed wheels of the rotor shafts of the respective rotors are dimensioned and arranged to mesh with one another;

wherein the toothed wheels of the rotor shafts are arranged so that teeth of the respective toothed wheels are subjected to a load only when the rotor shafts are driven in rotation asynchronously.

2. The dry vacuum pump according to claim 1, wherein an angular play of the toothed wheels is less than that of the respective rotor elements.

3. The dry vacuum pump according to claim 1, wherein the smooth section of the rotor shaft of each rotor is situated at one end of the respective rotor shaft.

4. The dry vacuum pump according to claim 1, wherein, on the rotor shaft of each rotor, the smooth section has a diameter less than that of the respective toothed wheel.

5. The dry vacuum pump according to claim 1, wherein the toothed wheels are of the same diameter and the smooth sections are of the same diameter.

6. The dry vacuum pump according to claim 1, wherein the belt surrounds partially one of the smooth sections and is pushed downward by another of the smooth sections.

7. The dry vacuum pump according to claim 1, wherein the toothed wheel and the smooth section of a said rotor shaft of a said rotor are located at the same axial end of the respective rotor shaft.

8. The dry vacuum pump according to claim 1, wherein each smooth section is situated on a circumferential surface of a respective discoid part.

9. The dry vacuum pump according to claim 8, wherein the discoid parts and the drive wheel are substantially in the same plane.

10. The dry vacuum pump according to claim 1, wherein points coming from projections of axes of rotation of the rotor shafts, of the rotors, and of the drive shaft are aligned on a plane which is perpendicular to said axes of rotation.

11. The dry vacuum pump according to claim 1, wherein a distance between the drive shaft and the rotor shaft closest to it is adjustable.

12. The dry vacuum pump according to claim 1, wherein the rotor elements have the form of lobes fitted into one another.

13. The dry vacuum pump according to claim 1, wherein the dry vacuum pump is a Roots pump, a screw pump or a claw pump.

14. The dry vacuum pump according to claim 1, wherein the dry vacuum pump is single-staged or multi-staged.

15. The dry vacuum pump according to claim 1, wherein said at least one belt is two belts.

* * * * *